US009290293B2

(12) United States Patent
Tilton

(10) Patent No.: US 9,290,293 B2
(45) Date of Patent: Mar. 22, 2016

(54) STORAGE SYSTEMS AND RELATED METHODS

(71) Applicant: Samuel A. Tilton, Lithia, FL (US)

(72) Inventor: Samuel A. Tilton, Lithia, FL (US)

( * ) Notice: Subject to any disclaimer, the term of this patent is extended or adjusted under 35 U.S.C. 154(b) by 0 days.

(21) Appl. No.: 14/146,609

(22) Filed: Jan. 2, 2014

(65) Prior Publication Data

US 2014/0183081 A1 Jul. 3, 2014

Related U.S. Application Data

(60) Provisional application No. 61/748,701, filed on Jan. 3, 2013.

(51) Int. Cl.

| | |
|---|---|
| ***A47F 5/08*** | (2006.01) |
| ***A47F 3/14*** | (2006.01) |
| ***B65D 5/50*** | (2006.01) |
| ***A47B 87/00*** | (2006.01) |
| ***A47B 47/00*** | (2006.01) |
| ***A47B 43/00*** | (2006.01) |
| ***B25H 3/00*** | (2006.01) |
| *A47B 88/04* | (2006.01) |
| *A47B 51/00* | (2006.01) |

(52) U.S. Cl.

CPC ..... *B65D 5/50* (2013.01); *A47B 43/003* (2013.01); *A47B 47/0091* (2013.01); *A47B 87/007* (2013.01); *A47B 88/04* (2013.01); *A47F 5/08* (2013.01); *B25H 3/00* (2013.01); *A47B 2051/005* (2013.01); *A47B 2088/0448* (2013.01)

(58) Field of Classification Search

CPC .... A47B 88/04; A47B 88/18; A47B 88/0407; A47B 43/003; A47B 51/00; A47B 53/00; A47B 2088/0448; A47B 2210/0024; A47B 96/067; A47B 87/005; A47B 87/007; A47B 87/00; A47B 47/0091; A47B 47/00; A47F 5/0892; A47F 3/063; A47F 5/08; A47F 5/0081; A47F 5/0093; A47F 5/0876; F21V 21/02; B65D 5/50; B25H 3/00

USPC ..... 211/117, 126.15, 85.29, 162, 87.01, 211/86.01; 312/245, 246, 349, 321; 248/342, 343, 317; 52/27, 39, 36.4; 16/94 R, 96 R

See application file for complete search history.

(56) References Cited

U.S. PATENT DOCUMENTS

| | | | | |
|---|---|---|---|---|
| 3,014,494 | A | 12/1961 | Scott et al. | |
| 3,045,612 | A | 7/1962 | Byrnes | |
| 3,124,402 | A * | 3/1964 | Rhoads | 312/350 |

(Continued)

*Primary Examiner* — Jennifer E Novosad

(74) *Attorney, Agent, or Firm* — Phillips Ryther & Winchester; Jared L. Cherry

(57) ABSTRACT

The present disclosure describes a storage system and related methods. A storage system may include a plurality of components configured to be arranged in a track. The track may include at least two substantially parallel rows of components. Each of the components of the track may include a support surface and a plurality of apertures configured to receive a fastener. The apertures may be used to secure the component to a support structure. Each of the components may also include a coupling component configured to couple adjacent components. The track may be configured to receive a storage container. The storage container may include a storage compartment and flange disposed at least partially around the storage compartment. The flange of the storage container may be configured to rest upon the support surfaces of at least two separate components in the track disposed on opposite sides of the storage container.

18 Claims, 13 Drawing Sheets

(56) References Cited

U.S. PATENT DOCUMENTS

| | | | | | |
|---|---|---|---|---|---|
| 3,172,371 | A | | 3/1965 | Gutridge et al. | |
| 3,544,186 | A | | 12/1970 | Bjorge | |
| 3,651,581 | A | | 3/1972 | Lehman | |
| 3,655,063 | A | * | 4/1972 | Landry | 211/41.2 |
| 3,698,782 | A | * | 10/1972 | Onori | 312/350 |
| 3,729,242 | A | * | 4/1973 | Barney | 312/107 |
| 3,969,865 | A | | 7/1976 | Andersen | |
| 4,140,225 | A | | 2/1979 | Hilgers et al. | |
| 4,319,863 | A | | 3/1982 | Voges | |
| 4,527,694 | A | * | 7/1985 | Bolt et al. | 211/46 |
| 4,599,829 | A | | 7/1986 | Di Martino | |
| 4,619,575 | A | | 10/1986 | Summa et al. | |
| 4,632,472 | A | * | 12/1986 | Bross | 312/246 |
| 4,738,369 | A | * | 4/1988 | Desjardins | 211/113 |
| 4,991,725 | A | * | 2/1991 | Welsch et al. | 211/162 |
| 5,154,305 | A | | 10/1992 | Whitney | |
| 5,199,843 | A | | 4/1993 | Sferra | |
| 5,230,554 | A | * | 7/1993 | Camilleri | 312/334.6 |
| 5,649,751 | A | | 7/1997 | Longhurst | |
| 5,749,479 | A | * | 5/1998 | Belokin et al. | 211/113 |
| 5,964,359 | A | * | 10/1999 | Marino, Jr. | 211/74 |
| 6,056,378 | A | * | 5/2000 | Semon et al. | 312/246 |
| 6,145,678 | A | | 11/2000 | Morrison | |
| 6,173,662 | B1 | | 1/2001 | Donovan | |
| 6,527,227 | B1 | | 3/2003 | Lambiaso | |
| 6,701,686 | B1 | | 3/2004 | Platt | |
| 6,725,608 | B1 | | 4/2004 | Kraus | |
| 7,216,838 | B1 | * | 5/2007 | Gretz | 248/200.1 |
| 7,240,460 | B2 | | 7/2007 | Platt | |
| 7,293,393 | B2 | | 11/2007 | Kelly et al. | |
| 7,316,380 | B2 | | 1/2008 | Arakawa | |
| 7,357,262 | B2 | | 4/2008 | Fratilla | |
| 7,469,793 | B2 | * | 12/2008 | Chen | 211/162 |
| 7,484,461 | B2 | | 2/2009 | Britcher | |
| 7,516,585 | B2 | | 4/2009 | Lehane et al. | |
| 7,597,203 | B2 | * | 10/2009 | Jasniy | 211/119 |
| 7,614,195 | B2 | | 11/2009 | Platt et al. | |
| 7,651,065 | B2 | | 1/2010 | Sloan | |
| 7,762,636 | B2 | * | 7/2010 | Veeser et al. | 312/330.1 |
| 7,850,412 | B2 | | 12/2010 | Benedict et al. | |
| 7,874,116 | B2 | | 1/2011 | LaLonde | |
| 7,895,955 | B2 | | 3/2011 | Ferder et al. | |
| 7,910,573 | B2 | | 3/2011 | Beckmann et al. | |
| 8,091,721 | B1 | | 1/2012 | Gretz | |
| 8,104,188 | B1 | | 1/2012 | Aguilar | |
| 8,117,970 | B1 | | 2/2012 | Baez | |
| 8,176,700 | B2 | | 5/2012 | Butcher et al. | |
| 8,561,358 | B2 | | 10/2013 | Rowan | |
| 8,782,962 | B1 | * | 7/2014 | Schoewe | 52/39 |
| 2004/0020915 | A1 | * | 2/2004 | Shei | 219/385 |
| 2005/0160696 | A1 | | 7/2005 | Kelly et al. | |
| 2005/0210803 | A1 | | 9/2005 | Holloway | |
| 2005/0258722 | A1 | | 11/2005 | Sullivan | |
| 2006/0010811 | A1 | | 1/2006 | Platt | |
| 2006/0201899 | A1 | * | 9/2006 | Lin | 211/183 |
| 2007/0114196 | A1 | | 5/2007 | Cameron et al. | |
| 2007/0235615 | A1 | | 10/2007 | Tkachenko et al. | |
| 2008/0011928 | A1 | * | 1/2008 | Adrian et al. | 248/343 |
| 2008/0036341 | A1 | * | 2/2008 | Nilsen et al. | 312/246 |
| 2008/0203046 | A1 | | 8/2008 | Friesen et al. | |
| 2010/0108626 | A1 | | 5/2010 | Sorensen | |
| 2010/0242562 | A1 | | 9/2010 | Kempf | |
| 2010/0253519 | A1 | | 10/2010 | Brackmann | |
| 2011/0182704 | A1 | | 7/2011 | Mansor | |
| 2011/0209735 | A1 | | 9/2011 | Rowan | |
| 2011/0247284 | A1 | | 10/2011 | Butcher et al. | |
| 2012/0217366 | A1 | * | 8/2012 | Suciu et al. | 248/343 |
| 2013/0199016 | A1 | * | 8/2013 | Found | 29/428 |

* cited by examiner

STORAGE SYSTEMS AND RELATED METHODS

RELATED APPLICATION

The present application claims the benefit under 35 U.S.C. §119(e) of U.S. Provisional Patent Application No. 61/748,701, filed Jan. 3, 2013, and titled "STORAGE SYSTEMS AND RELATED METHODS," which is incorporated herein by reference in its entirety.

TECHNICAL FIELD

This disclosure relates to systems and methods for improving the utilization of storage space. More particularly, the present disclosure relates to overhead storage systems and related methods, which may be utilized for creating storage space in a wide variety of locations.

BRIEF DESCRIPTION OF THE DRAWINGS

Non-limiting and non-exhaustive embodiments of the disclosure are provided herein, including various embodiments of the disclosure illustrated in the figures listed below.

DETAILED DESCRIPTION

Figure 1:
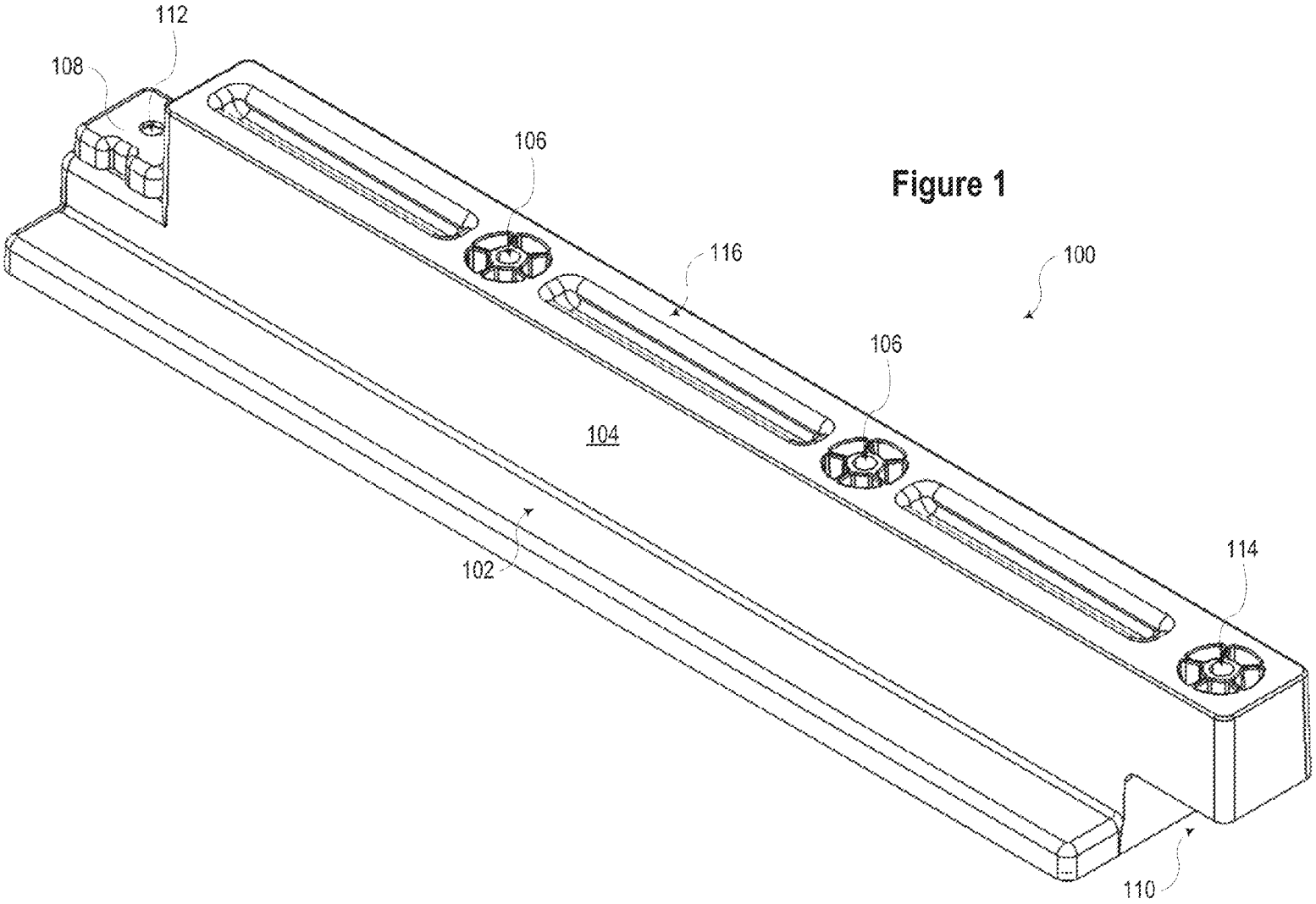
FIG. 1 illustrates an isometric view of a component of an overhead storage system, according to various embodiments consistent with the present disclosure.

In the following description, numerous specific details are provided for a thorough understanding of the various embodiments disclosed herein. The systems and methods disclosed herein can be practiced without one or more of the specific details, or with other methods, components, materials, etc. In addition, in some cases, well-known structures, materials, or operations may not be shown or described in detail in order to avoid obscuring aspects of the disclosure. Furthermore, the described features, structures, or characteristics may be combined in any suitable manner in one or more alternative embodiments.

Disclosed herein are a variety of systems and methods that may be utilized to improve utilization of storage space. Specifically, the various embodiments disclosed herein facilitate the creation of overhead storage utilizing a modular storage system configured to suspend storage containers. Such systems may be utilized in a variety of applications and settings. For example, the systems and methods disclosed herein may be utilized in a home environment, for example by installing a system consistent with the present disclosure in a garage, and thereby creating additional storage space. In addition, the systems and methods disclosed herein may be incorporated into commercial enterprises in order to improve utilization of available space by creating additional overhead storage. The systems and methods disclosed herein may be utilized in connection with moving vehicles, storage units, storage sheds, and the like.

According to some embodiments consistent with the present disclosure, the plurality of modular components may be utilized in order to create one or more tracks configured to receive storage containers. The modular components may permit a user to create a track of a desired length. The modular design of the systems disclosed herein may allow a user to create a storage system within the area available to the user or suitable to a particular user's intended application of the storage system.

Methods disclosed herein may relate to the use of a storage system, consistent with the present disclosure, in which stored items are sequentially loaded into a storage system and unloaded from the storage system in the same order. Such methods may readily be applicable to storage of a variety of items commonly stored by households and commercial entities. For example, the home environment seasonal items (e.g. decorations, clothing, etc.) are likely to be retrieved annually in the same order. Accordingly, such items may be loaded into a storage system consistent with the present disclosure in the order in which such items are likely to be unloaded from the storage system.

According to some embodiments, specific storage containers may also be utilized that are configured to improve the accessibility of storage containers stored in a system consistent with the present disclosure. For example, a system may be configured to store a plurality of storage containers. According to some embodiments, storage containers consistent with the present embodiment may be configured to rotate with respect to the track in order to facilitate non-sequential removal of a desired storage container.

The embodiments of the disclosure will be best understood by reference to the drawings, wherein like parts are designated by like numerals throughout. The components of the disclosed embodiments, as generally described and illustrated in the figures herein, could be arranged and designed in a wide variety of different configurations. Furthermore, the features, structures, and operations associated with one embodiment may be applicable to or combined with the features, structures, or operations described in conjunction with another embodiment.

It will be appreciated that terms such as "right," "left," "top," "bottom," "above," and "side," as used herein, are merely for ease of description and refer to the orientation of the systems, features, and/or components shown in the figures. It should be understood that any orientation of the systems, features, and/or components described herein is within the scope of the present disclosure.

Thus, the following detailed description of the embodiments of the systems and methods of the disclosure is not intended to limit the scope of the disclosure, as claimed, but is merely representative of possible embodiments.

FIG. 1 illustrates an isometric view of a component 100 of an overhead storage system, according to various embodiments consistent with the present disclosure. Component 100 includes a support surface 102 upon which a flange of a storage container (not shown) may be supported. According to some embodiments, support surface 102 may comprise a low-friction surface, rollers, or other implements in order to facilitate sliding storage containers along support surface 102. Support surface 102 may extend horizontally from a beam 104. Beam 104 may further engage with a storage container and to keep such storage containers suspended within an overhead storage system.

Component 100 includes a plurality of apertures 106 that may be utilized to mount component 100 to an overhead surface (e.g., a ceiling, a rafter, etc.). Apertures 106 may be configured to permit the passage of a fastening device, such as a screw, nail, rivet, bolt, anchor, or the like. An appropriate fastening device may be selected based upon the type of overhead structure to which component 100 is attached. For example, a wood screw may be appropriate when component 100 is to be attached to a wooden overhead structure, while a metal screw may be appropriate when component 100 is to be attached to a metal overhead structure. When mounted, a top surface 116 of component 100 may abut an overhead support structure, such as a ceiling, a rafter, and the like. According to one embodiment, apertures 106 may be spaced so as to facilitate attachment to studs in commercial or residential construction. In one particular embodiment, the distance between apertures may be 8". Such an embodiment may facilitate attachment of component 100 to studs having either a 16" spacing or a 24" spacing.

Component 100 may be configured to couple to additional components of an overhead storage system (not shown) using a protruding component 108 and a receiving component 110. As may be appreciated, protruding component 108 may be configured to be received within a receiving component (not shown) of an adjacent segment of an overhead storage system. Similarly, a receiving component 110 may be configured to couple with a protruding component (not shown) of another adjacent segment of the overhead storage system. A fastener may pass through a protruding component aperture 112 to secure adjacent components of an overhead storage system together. Similarly, a receiving component aperture 114 may be configured to permit passage of a fastener to secure component 100 to another adjacent component of the overhead storage system.

According to various embodiments, component 100 may be integrally formed using any of a variety of manufacturing techniques. As the term is used herein, integrally formed refers to a component formed of a single piece of material. According to various embodiments, component 100 may be formed using plastic, metal, wood, and other materials. An appropriate material may be selected based upon a variety of factors, including a determination of the weight that component 100 is to support.

Figure 2:
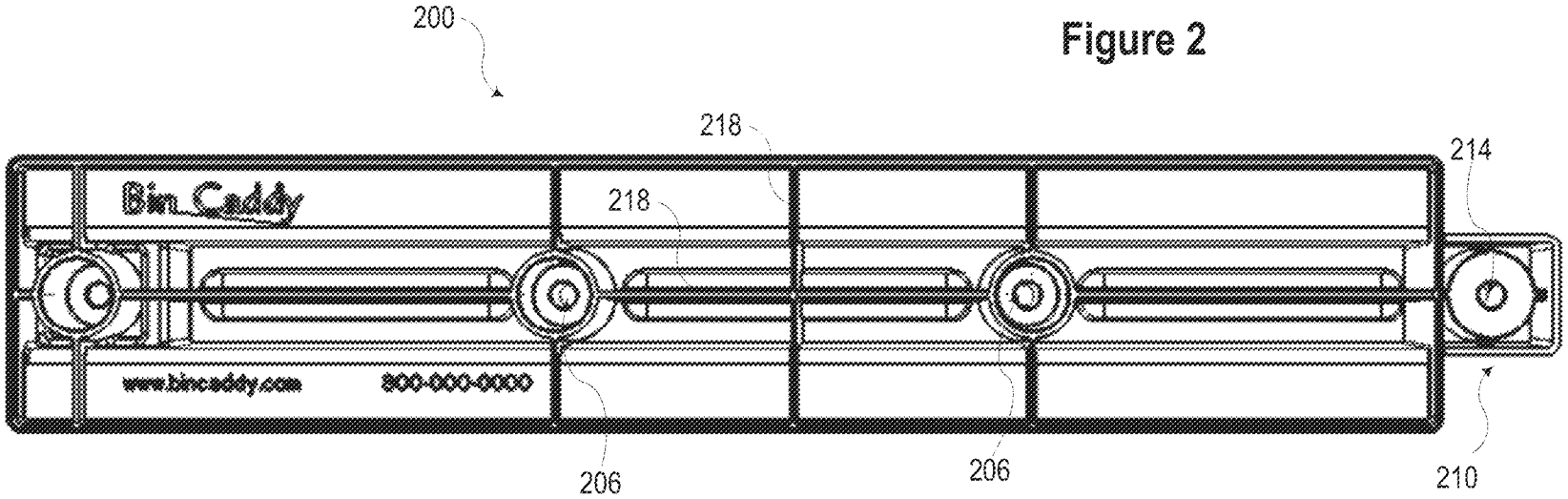
FIG. 2 illustrates a bottom view of the component illustrated in FIG. 1, according to various embodiments consistent with the present disclosure.

FIG. 2 illustrates a bottom view of a component 200 of an overhead storage system, according to various embodiments consistent with the present disclosure. Component 200 includes apertures 206 that may be utilized to mount component 200 to an overhead surface. As illustrated, apertures 206 may narrow in order to accommodate a fastening device (not shown) with a large head, a washer, or other implement used in connection with the fastening device.

Component 200 may be hollow in order to reduce the amount of material necessary to form component 200. A plurality of ribs 218 may be disposed within component 200 in order to add strength to component 200 and prevent deformation of component 200 that may be caused by weight associated with storage containers supported by component 200. Ribs 218 may be integrally formed or may be formed of other materials depending upon a weight that component 200 is expected to support. According to some embodiments, for example, ribs 218 may be formed of plastic and reinforced using metal.

Figure 3:
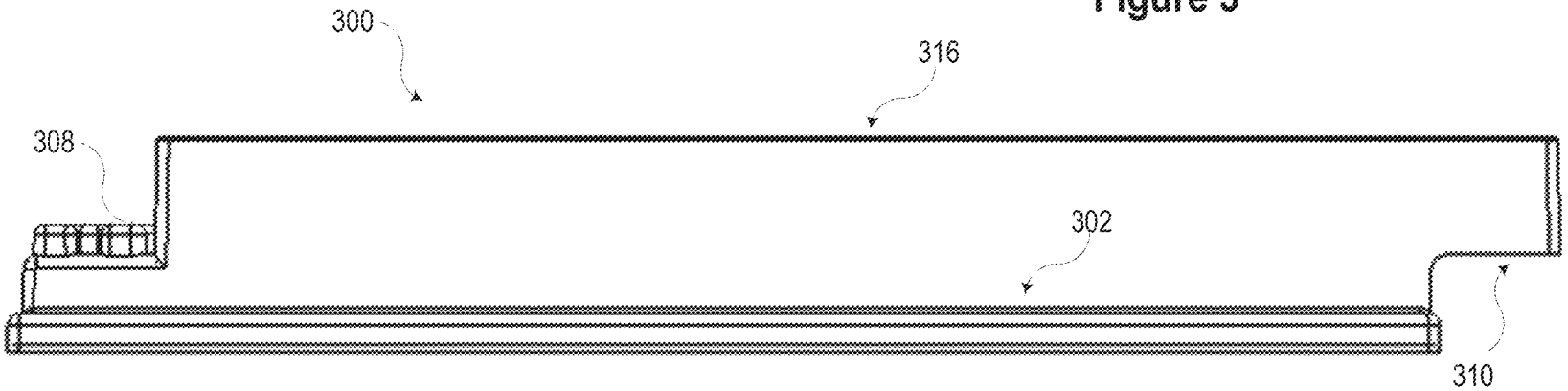
FIG. 3 illustrates a side view of the component illustrated in FIG. 1, according to various embodiments consistent with the present disclosure.

FIG. 3 illustrates a side view of a component 300 of an overhead storage system, according to various embodiments consistent with the present disclosure. Component 300 includes a top surface 316 that may be configured to abut an overhead structure to which component 300 may be attached. A support surface 302 is disposed proximate the bottom of component 300. A protruding component 308 is disposed on one end of component 300 and a receiving component 310 may be disposed on the opposite end of component 300. Protruding component 308 may be configured to couple to an adjacent component (not shown), and receiving component 310 may be configured to couple to another adjacent component (not shown). Protruding component 308 and receiving component 310 may be utilized to form a plurality of components into an overhead track for supporting one or more storage containers.

Figure 4A:
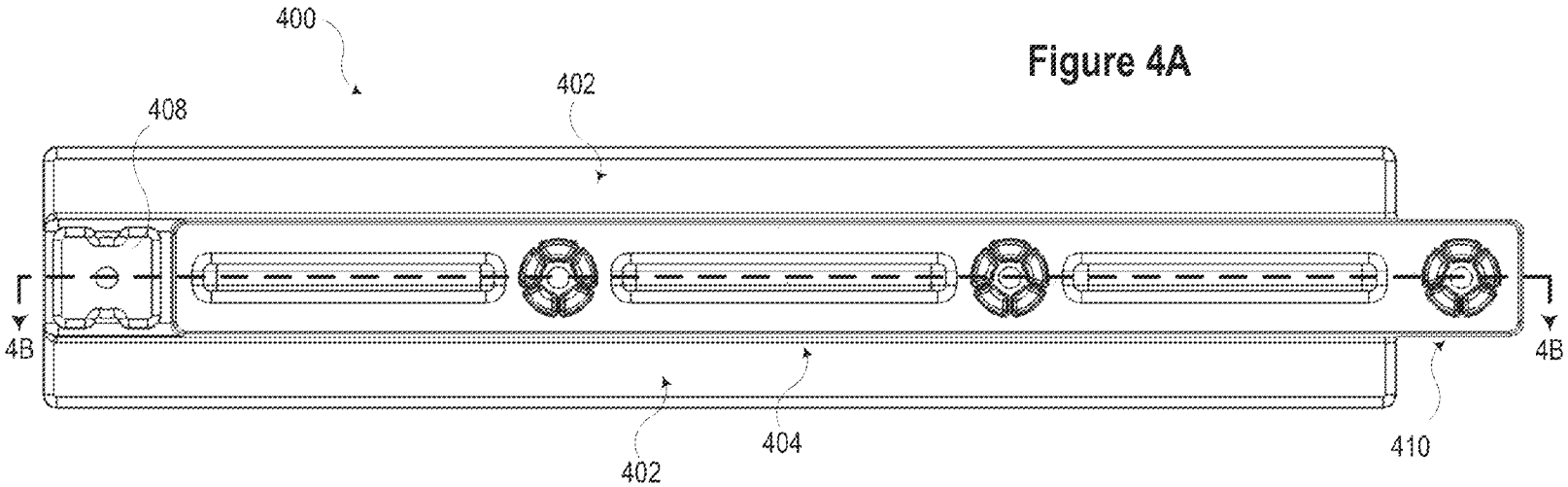
FIG. 4A illustrates a top view of the component illustrated in FIG. 1, according to various embodiments consistent with the present disclosure.

FIG. 4A illustrates a top view of a component 400 of an overhead storage system, according to various embodiments consistent with the present disclosure. As illustrated, component 400 may include support surfaces 402 on both sides of a beam 404. Accordingly, component 400 may be utilized as part of multiple tracks of an overhead storage system. Component 400 includes a protruding component 408 and a receiving component 410 that may be utilized to couple component 400 to adjacent components of an overhead storage system.

Figure 4B:
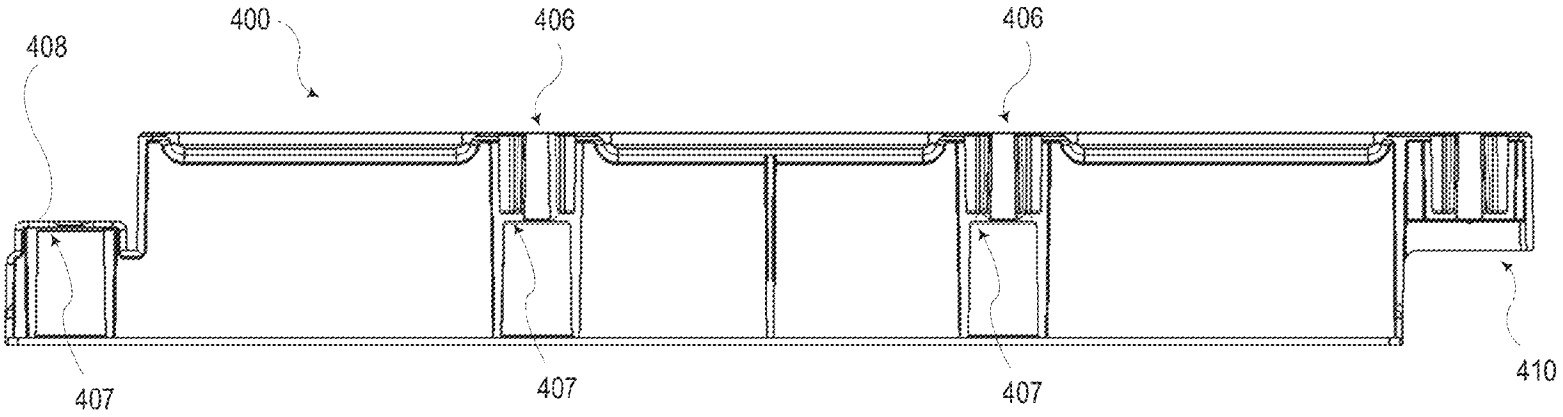
FIG. 4B illustrates a cross-sectional view of the component illustrated in FIG. 4A and taken along line 4B-4B, according to various embodiments consistent with the present disclosure.

FIG. 4B illustrates a cross-sectional view of component 400 of an overhead storage system illustrated in FIG. 4A, according to various embodiments consistent with the present disclosure. The cross-sectional view illustrated in FIG. 4B shows additional detail relating to protruding component 408 and receiving component 410. Specifically, as may be appreciated from the illustration, receiving component 410 may be dimensioned to receive a protruding component 408 of an adjacent component of a storage system.

As further illustrated in FIG. 4B, apertures 406 may include a shoulder 407 against which a head of a fastening device or a washer may be seated in order to secure component 400 to an overhead surface. Further apertures 406 may be sufficiently large for a tool (e.g., a screw driver, a socket wrench, etc.) to be inserted in order to secure a fastener into an overhead support structure.

Figure 5:
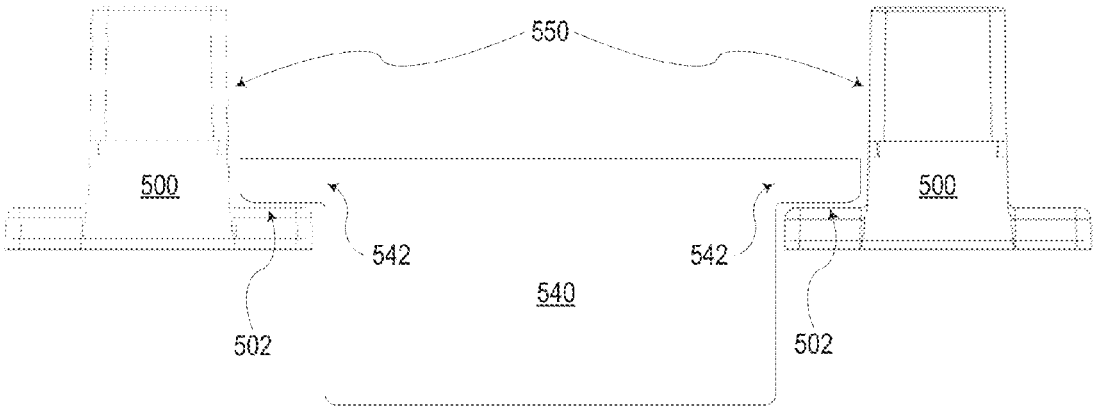
FIG. 5 illustrates an end view of an overhead storage system including a storage container suspended in a track that is formed by two components.

FIG. 5 illustrates an end view of storage system including a storage container 540 suspended in a track 550 that is formed by two components 500. Storage container 540 may include flanges 542 disposed along at least a portion of the perimeter of storage container 540. Flanges 542 may be supported on support surfaces 502, which are associated with components 500 disposed on opposite sides of storage container 540.

According to certain embodiments consistent with the present disclosure, flanges 542 may be configured in order to allow at least some rotation of storage container 540 with respect to track 550. Further, storage container 540 may be generally rectangular such that a length of storage container 540 exceeds the width of storage container 540. Components 500 may be placed at a sufficient distance to accommodate the length of storage container 540. Given that the length of storage container 540 is greater than its width, if storage container 540 is rotated such that it is generally parallel with track 550, storage container 540 may be removed from track 550. A flange associated with a storage container 540 configured to permit rotation of the container with respect to the track may, according to some embodiments, be approximately semicircular.

Figure 6:
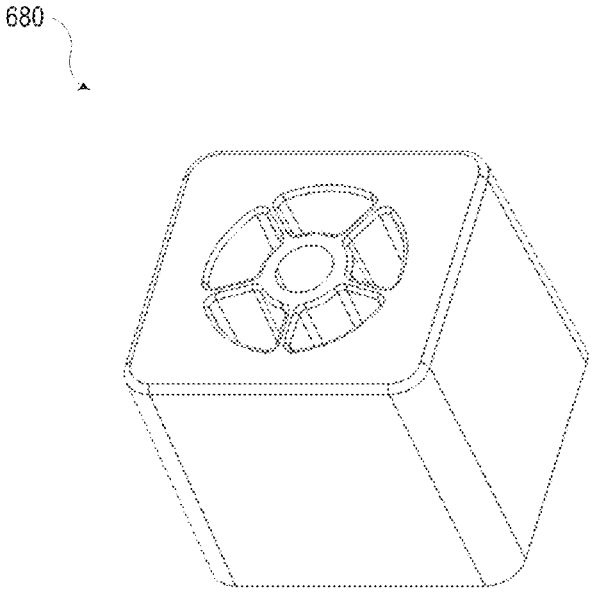
FIG. 6 illustrates an isometric view of a spacer component of an overhead storage system, according to various embodiments consistent with the present disclosure.

FIG. 6 illustrates an isometric view of a spacer component 680 of an overhead storage system, according to various embodiments consistent with the present disclosure. Component 680 may be configured to couple with a protruding component (not shown) at the end of a track of a storage system according to the present disclosure. As illustrated in FIG. 3, for example, a protruding component 308 may be below a top surface 316. A spacer component 680 may be inserted at the end of a track in order to ensure that a top surface is flat across the length of a component of a track of a storage system.

Figure 7:
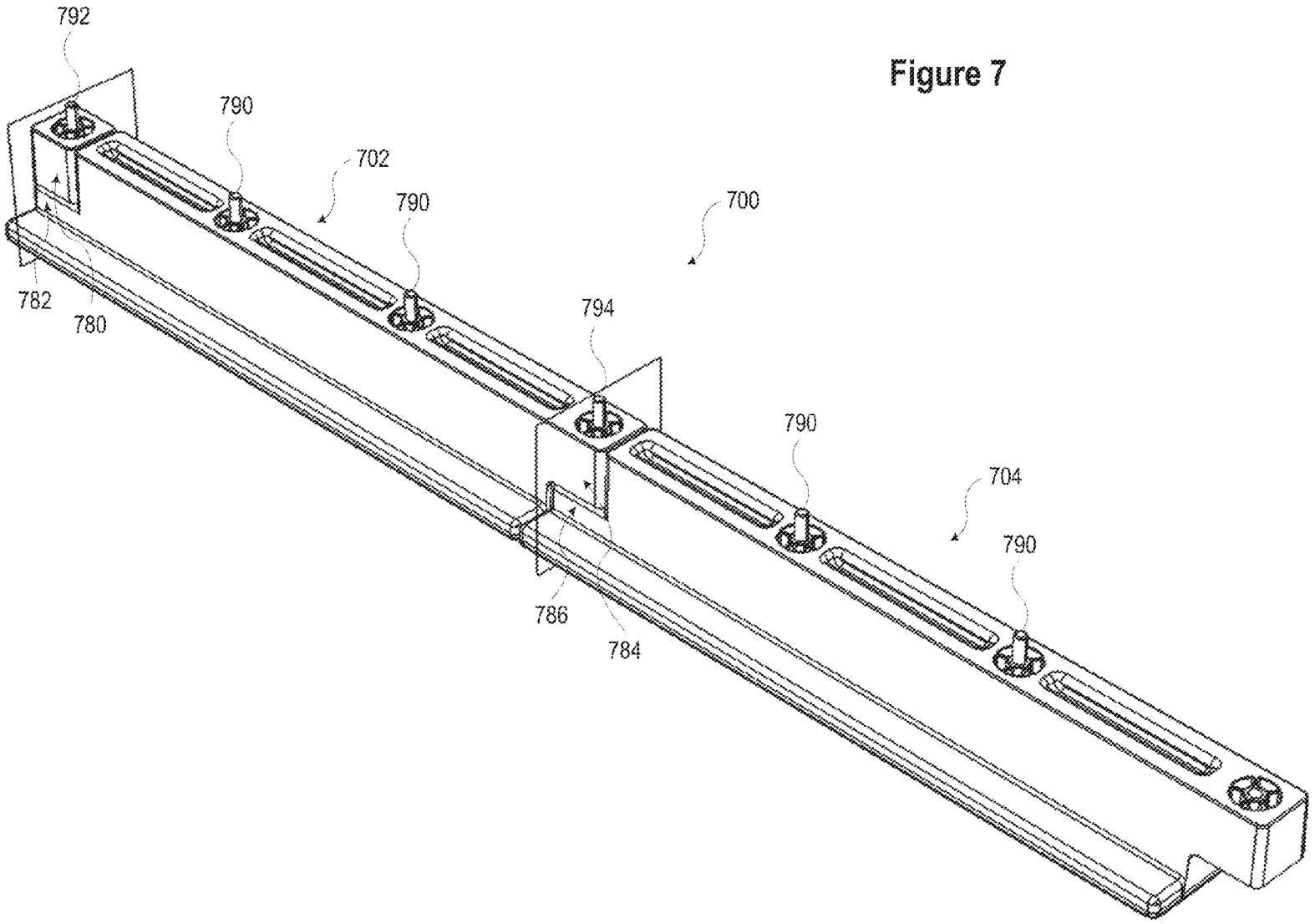
FIG. 7 illustrates an isometric view of two components of a storage system coupled together, according to various embodiments consistent with the present disclosure.

FIG. 7 illustrates an isometric view of a portion of a track 700 that includes two components 702 and 704 coupled together, according to various embodiments consistent with the present disclosure. The portion of track 700 may be a part of a storage system configured to receive a plurality of storage containers and to suspend such storage containers from an overhead surface.

A spacer component 780 is coupled to component 702. As illustrated, spacer component 780 may be used at one end of the portion of track 700. A fastener 792 may extend through spacer component 780 and a coupling component 782 of component 702. The coupling component may be a protruding component, similar to protruding component 408, which is illustrated in FIG. 4A.

Returning to a discussion of FIG. 7, a coupling component 784 associated with component 702 may couple with a coupling component 786 associated with component 704. According to various embodiments described previously, the coupling components 784 and 786 may comprise a protruding component and a receiving component, respectively. A fastener 794 may extend through the coupling component 784 and 786 in order to secure component 702 and 704 together.

A plurality of fasteners 790 may extend through each of components 702 and 704. Fastener 790 may be configured to secure the portion of track 700 to an overhead support surface (not shown). According to various embodiments, fastener 790 may comprise screws, nails, rivets, bolts, incurs, and the like.

Figure 8A:
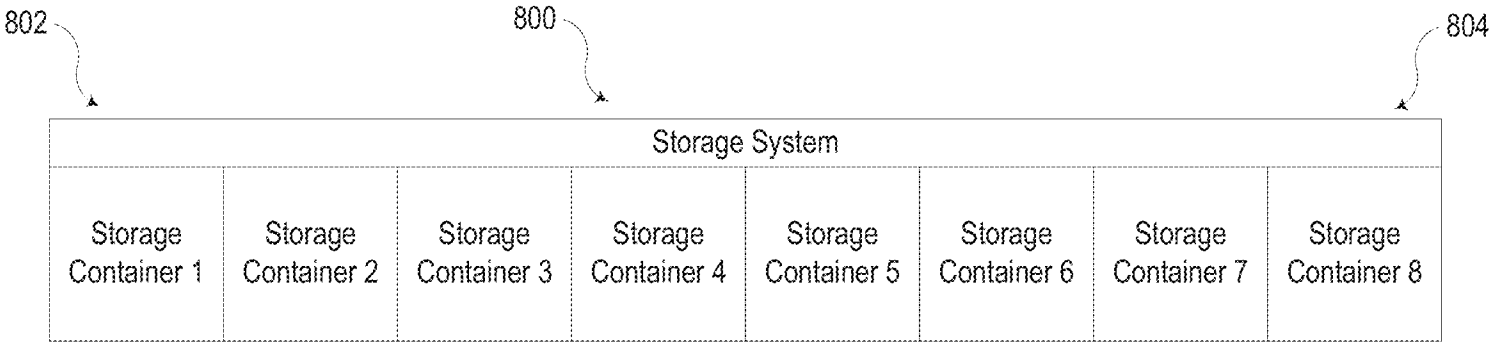
FIG. 8A illustrates a diagram of a storage system including a plurality of storage containers, according to various embodiments consistent with the present disclosure.
Figure 8B:
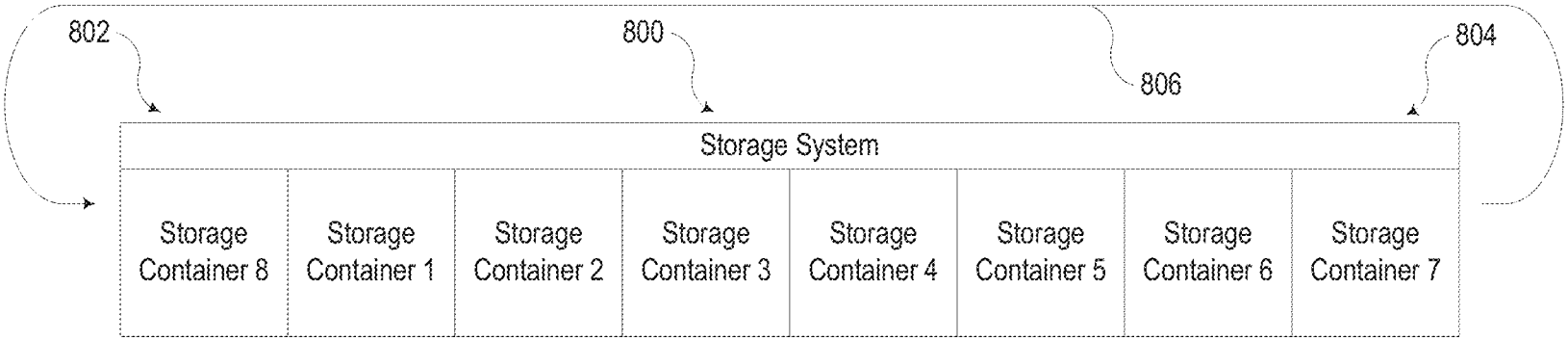
FIG. 8B illustrates that the storage system depicted in FIG. 8A may be utilized for rotating a plurality of storage containers according to various methods consistent with the present disclosure.

Some embodiments of storage systems according to the present disclosure may be utilized with various methods according to the present disclosure. One such method is illustrated in FIGS. 8A and 8B. FIG. 8A illustrates a diagram of a storage system 800 that may be utilized for rotating a plurality of storage containers according to various methods consistent with the present disclosure. As illustrated in FIG. 8A, storage containers 1 through 8 are stored in a storage system in sequential order. Storage system 800 may allow for storage containers to be removed from or added to a first end 802 or removed from or added to a second end 804.

In FIG. 8B, an arrow 806 illustrates removal of a storage container from the second end 804 and the addition of the storage container to the first end 802. As shown, storage container 8 is removed from second end 804 and added to the first end 802. This same process may be repeated as desired.

The system 802 may be utilized for storing items that may be removed from storage in a pre-determined order. For example, a storage system such as the system shown in FIG. 8B may be utilized for storing holiday decorations, seasonal clothing, or the like. Since holiday decorations, seasonal clothing, and other seasonal items are removed from storage and utilized in the same order each year, these items may be stored in a storage system configured to permit sequential addition and removal of storage containers.

Figure 9:
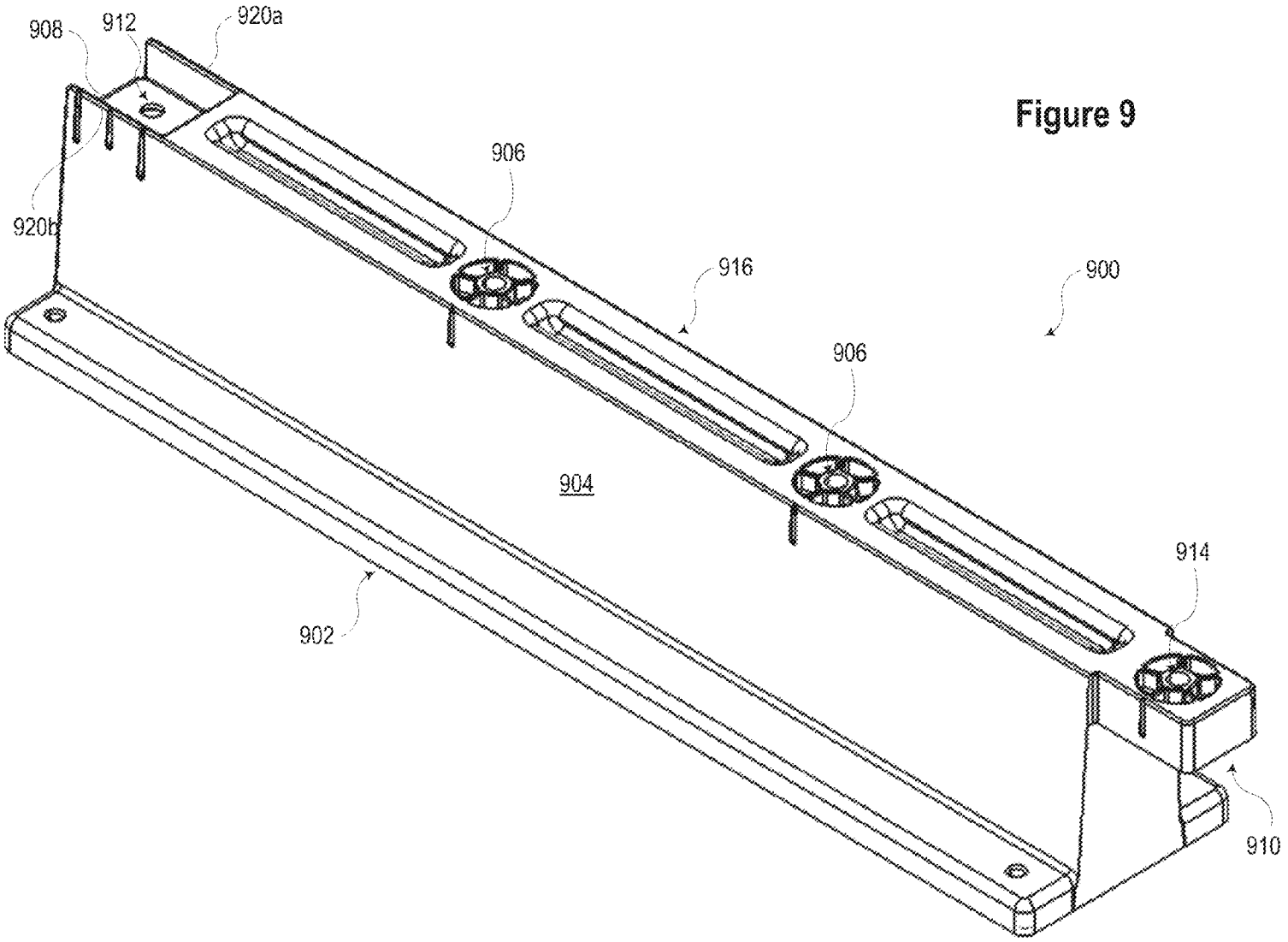
FIG. 9 illustrates an isometric view of a component of an overhead storage system having a consistent height across its length to facilitate mounting to a planar surface without use of a spacing component, according to various embodiments consistent with the present disclosure.

FIG. 9 illustrates an isometric view of a component 900 of an overhead storage system having a consistent height across its length to facilitate mounting to a planar surface without use of a spacing component, according to various embodiments consistent with the present disclosure. Component 900 includes a support surface 902 upon which a flange of a storage container (not shown) may be supported. According to some embodiments, support surface 902 may comprise a low-friction surface, rollers, or other implements in order to facilitate sliding storage containers along support surface 902. Support surface 902 may extend horizontally from a beam 904. Beam 904 may further engage with a storage container and to keep such storage containers suspended within an overhead storage system.

Component 900 includes a plurality of apertures 906 that may be utilized to mount component 900 to an overhead surface (e.g., a ceiling, a rafter, etc.). Apertures 906 may be configured to permit the passage of a fastening device, such as a screw, nail, rivet, bolt, anchor, or the like. An appropriate fastening device may be selected based upon the type of overhead structure to which component 900 is attached. When mounted, a top surface 916 of component 900 may abut an overhead support structure, such as a ceiling, a rafter, and the like. According to one embodiment, apertures 906 may be spaced so as to facilitate attachment to studs in commercial or residential construction. In one particular embodiment, the distance between apertures may be 8". Such an embodiment may facilitate attachment of component 900 to studs having either a 16" spacing or a 24" spacing.

Component 900 may be configured to couple to additional components of an overhead storage system (not shown) using a protruding component 908 and a receiving component 910. As may be appreciated, protruding component 908 may be configured to be received within a receiving component (not shown) of an adjacent segment of an overhead storage system. Similarly, a receiving component 910 may be configured to couple with a protruding component (not shown) of another adjacent segment of the overhead storage system. A fastener may pass through a protruding component aperture 912 to secure adjacent components of an overhead storage system together. Similarly, a receiving component aperture 914 may be configured to permit passage of a fastener to secure component 902 to another adjacent component of the overhead storage system.

Two ribs 920*a*, 920*b* extend in the same plane as top surface 916 in proximity to protruding component 908. According to various embodiments, ribs 920*a*, 920*b* may create a consistent height across the length of component 900 to facilitate mounting to an overhead surface without use of a spacing component, such as the spacing component illustrated in FIG. 6. As described in connection with FIG. 6, a spacer component may be inserted at the end of a track in certain embodiments in order to ensure that a top surface is flat across the length of a component of a track of a storage system. Returning to a discussion of FIG. 9, ribs 920*a*, 920*b* may similarly provide a top surface that is flat across the length of component 900.

According to various embodiments, component 900 may be integrally formed using any of a variety of manufacturing techniques. As the term is used herein, integrally formed refers to a component formed of a single piece of material. According to various embodiments, component 900 may be formed using plastic, metal, wood, and other materials. An appropriate material may be selected based upon a variety of factors, including a determination of the weight that component 900 is to support.

Figure 10:
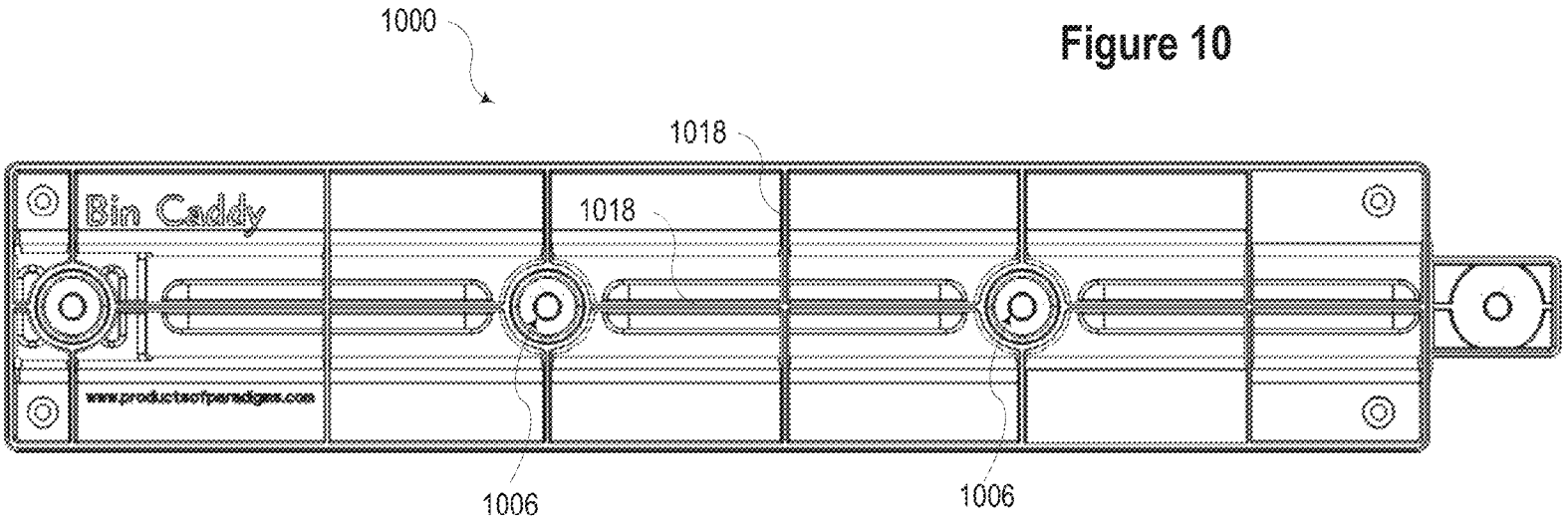
FIG. 10 illustrates a bottom view of the component illustrated in FIG. 9, according to various embodiments consistent with the present disclosure.

FIG. 10 illustrates a bottom view of the component illustrated in FIG. 9, according to various embodiments consistent with the present disclosure. FIG. 10 illustrates a bottom view of a component 1000 of an overhead storage system, according to various embodiments consistent with the present disclosure. Component 1000 includes apertures 1006 that may be utilized to mount component 1000 to an overhead surface. As illustrated, apertures 1006 may narrow in order to accommodate a fastening device (not shown) with a large head, a washer, or other implement used in connection with the fastening device.

In some embodiments, component 1000 may be hollow in order to reduce the amount of material necessary to form component 1000. A plurality of ribs 1018 may be disposed within component 1000 to add strength to component 1000 and prevent deformation of component 1000 that may be caused by weight associated with storage containers supported by component 1000. Ribs 1018 may be integrally formed or may be formed of other materials depending upon a weight that component 1000 is expected to support. According to some embodiments, for example, ribs 1018 may be formed of plastic and reinforced using metal.

Figure 11:
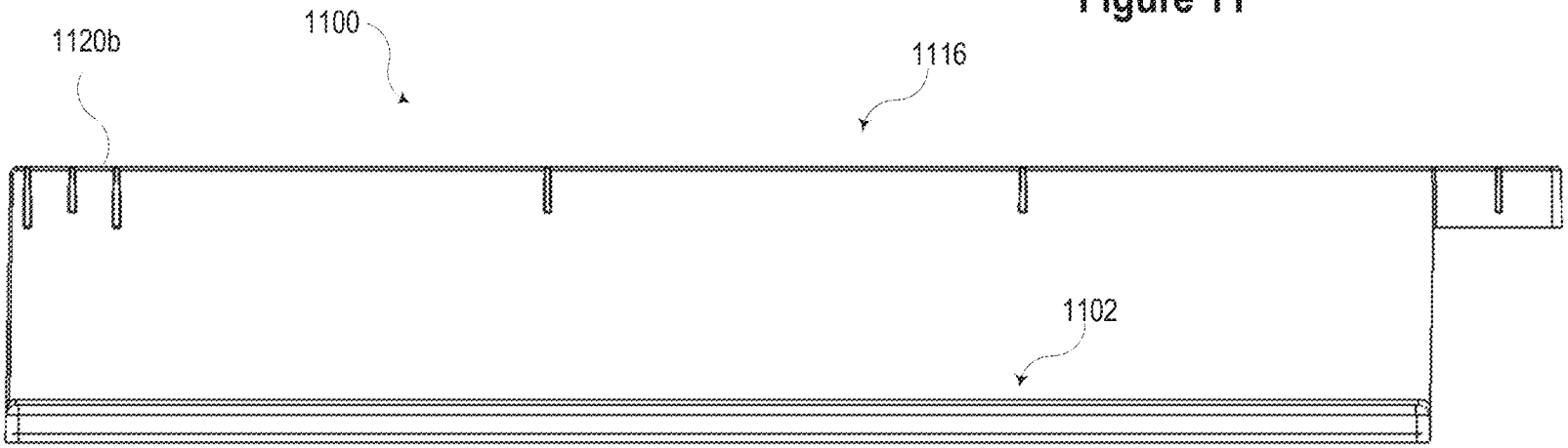
FIG. 11 illustrates a side view of the component illustrated in FIG. 9, according to various embodiments consistent with the present disclosure.

FIG. 11 illustrates a side view of the component illustrated in FIG. 9, according to various embodiments consistent with the present disclosure. Component 1100 includes a top surface 1116 that may be configured to abut an overhead structure to which component 1100 may be attached. A support surface 1102 is disposed proximate the bottom of component 1100. A rib 1120*b* may be disposed to such that the top surface 1116 is flat across the length of component 1100, consistent with various embodiments of the present disclosure.

Figure 12A:
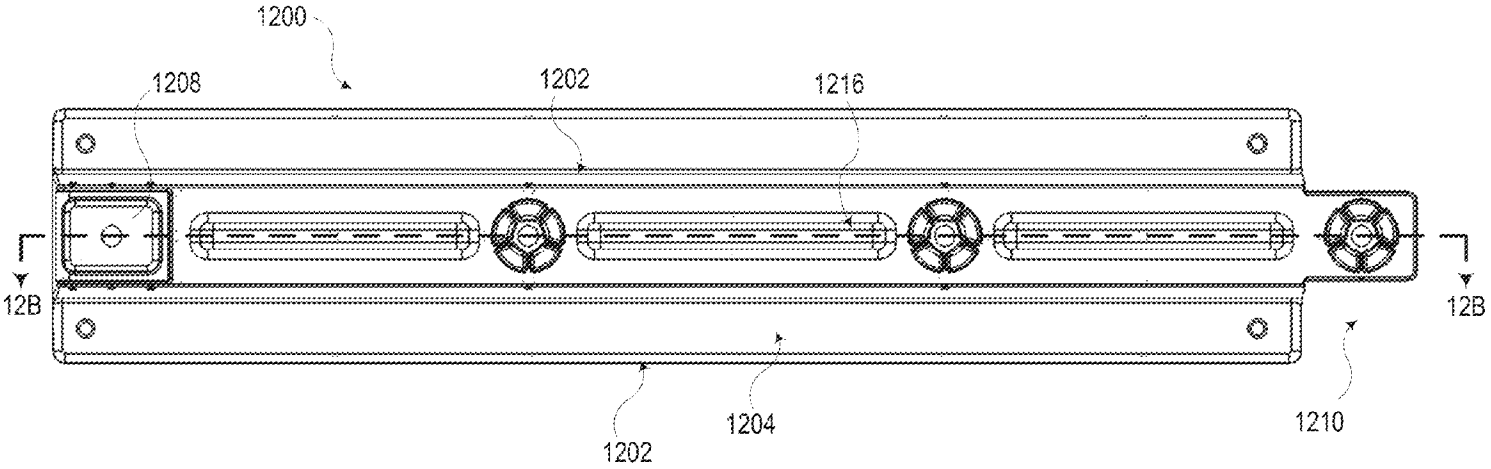
FIG. 12A illustrates a top view of the component illustrated in FIG. 9, according to various embodiments consistent with the present disclosure.

FIG. 12A illustrates a top view of the component illustrated in FIG. 9, according to various embodiments consistent with the present disclosure. As illustrated, component 1200 may include support surfaces 1202 on both sides of a beam 1204. Accordingly, component 1200 may be utilized as part of multiple tracks of an overhead storage system. Component 1200 includes a protruding component 1208 and a receiving component 1210 that may be utilized to couple component 1200 to adjacent components of an overhead storage system.

Figure 12B:
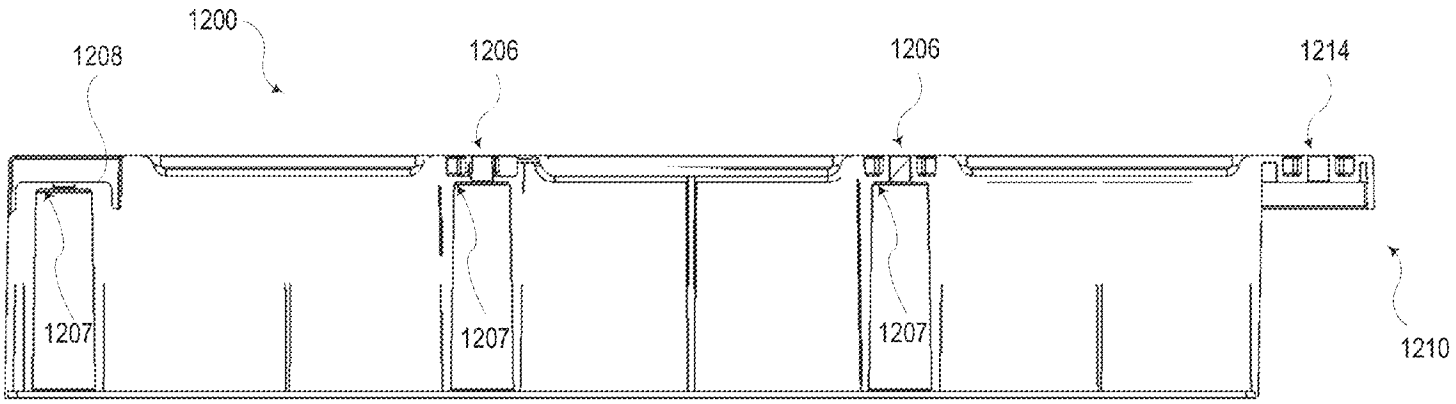
FIG. 12B illustrates a cross-sectional view of the component illustrated in FIG. 12A and taken along line 12B-12B, according to various embodiments consistent with the present disclosure.

FIG. 12B illustrates a cross-sectional view of the component illustrated in FIG. 12A and taken along line 12B-12B, according to various embodiments consistent with the present disclosure. As further illustrated in FIG. 12B, apertures 1206 may include a shoulder 1207 against which a head of a fastening device or a washer may be seated in order to secure component 1200 to an overhead surface. Further apertures 1206 may be sufficiently large for a tool (e.g., a screw driver, a socket wrench, etc.) to be inserted in order to secure a fastener into an overhead support structure.

Figure 13:
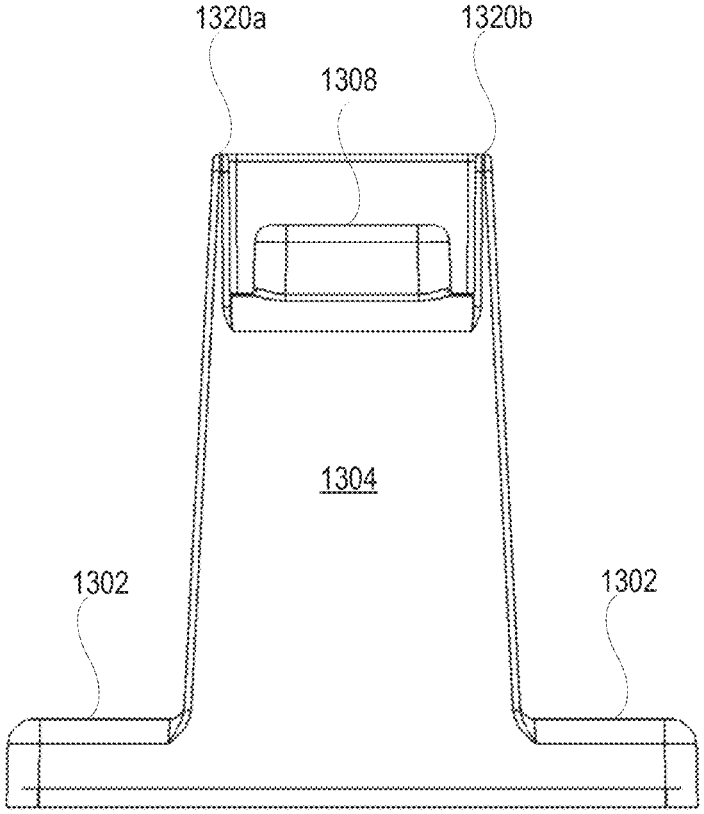
FIG. 13 illustrates an end view of the component illustrated in FIG. 9, according to various embodiments consistent with the present disclosure.

FIG. 13 illustrates an end view of the component illustrated in FIG. 9, according to various embodiments consistent with the present disclosure. As illustrated in FIG. 13, support surfaces 1302 are disposed on both sides of a beam. In alternative embodiments, only one support surface may be provided along one side of a component. As illustrated in FIG. 13, ribs 1320*a*, 1320*b* may be disposed on the sides of protruding component 1308. As previously described, protruding component 1308 may be received by a receiving component (not shown) of an adjacent component.

Figure 14:
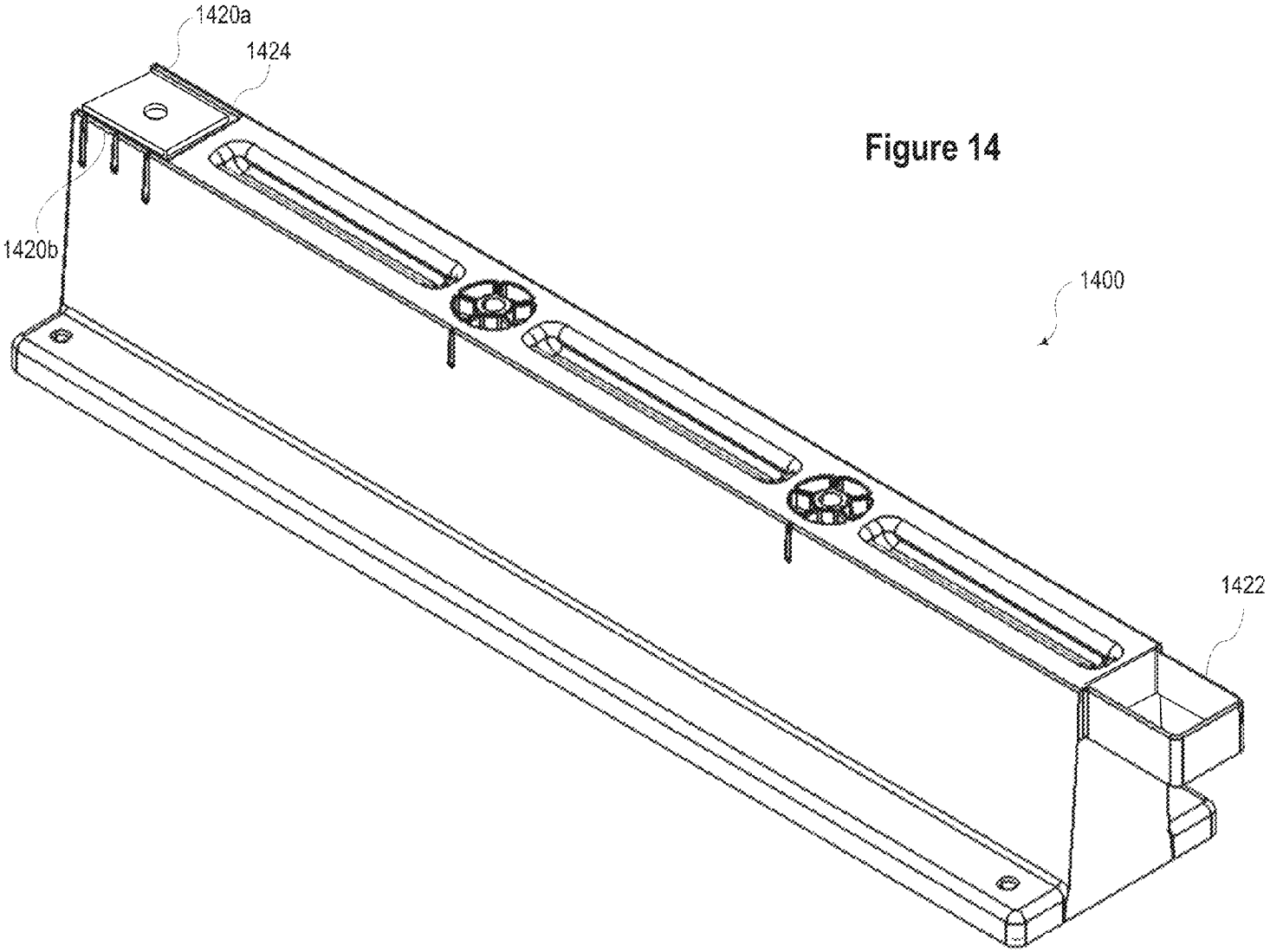
FIG. 14 illustrates an isometric view of a component of an overhead storage system having a consistent height across its length to facilitate mounting to a planar surface without use of a spacing component, according to various embodiments consistent with the present disclosure.

FIG. 14 illustrates an isometric view of a component 1400 of an overhead storage system having a consistent height across its length to facilitate mounting to a planar surface without use of a spacing component, according to various embodiments consistent with the present disclosure. Component 1400 may, in general, operate similar to the embodiments described in connection with FIG. 1 and FIG. 9. As described in connection with component 900, component 1400 may have a consistent height across its length to facilitate mounting to a planar surface.

Component 1400 may be configured to couple to adjacent components (not shown) to form a track that may hold one or more storage containers (not shown). In the illustrated embodiment, a U-shaped extension 1422 may extend from one end of component 1400. A U-shaped channel 1424 may be disposed at the opposite end of component 1400. As may be appreciated, multiple components may be joined together by successively coupling the U-shaped extension on one component to a U-shaped channel of an adjacent component.

Figure 15:
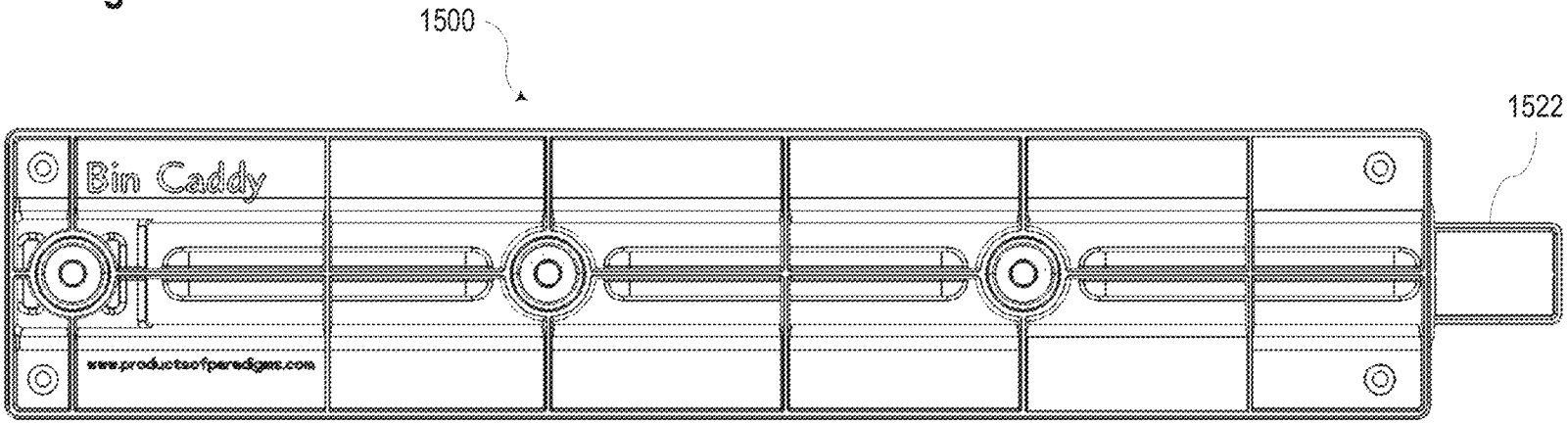
FIG. 15 illustrates a bottom view of the component illustrated in FIG. 14, according to various embodiments consistent with the present disclosure.

FIG. 15 illustrates a bottom view of the component illustrated in FIG. 14, according to various embodiments consistent with the present disclosure. As illustrated, the U-shaped extension 1522 may be open and configured to couple to a U-shaped channel of an adjacent component of a storage system.

Figure 16:
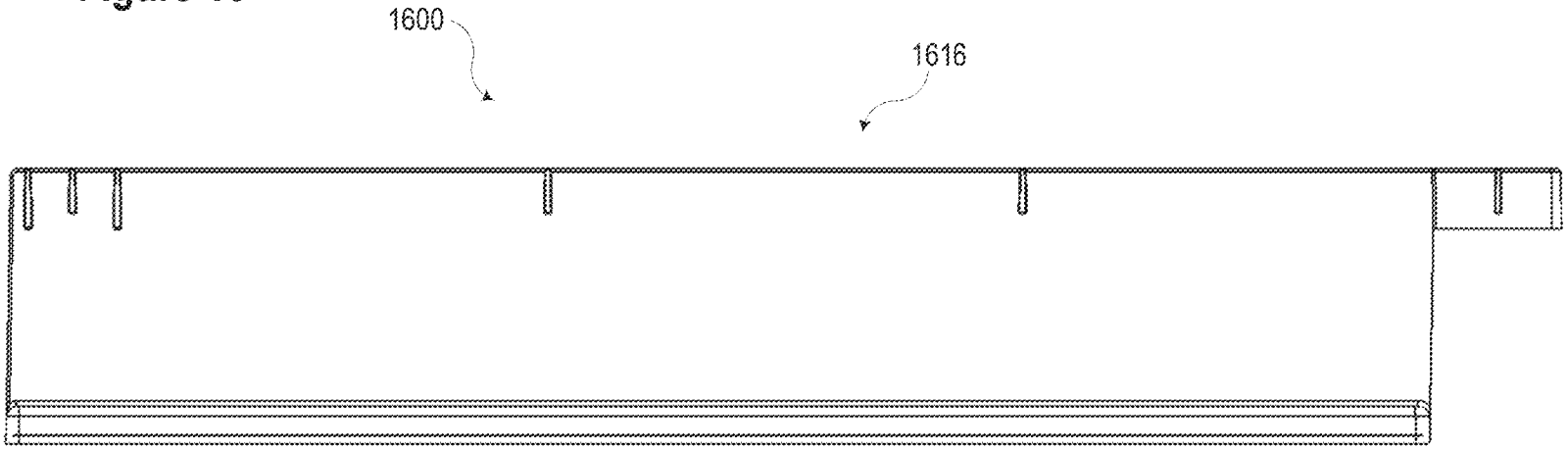
FIG. 16 illustrates a side view of the component illustrated in FIG. 14, according to various embodiments consistent with the present disclosure.

FIG. 16 illustrates a side view of the component illustrated in FIG. 14, according to various embodiments consistent with the present disclosure. As illustrated, component 1600 may have a component of an overhead storage system having a consistent height across a top surface 1616 to facilitate mounting to a planar surface without use of a spacing component. As described in connection with other embodiments component 1600 may be mounted to a ceiling, a rafter, and the like using fastening devices, such as a screw, nail, rivet, bolt, anchor, or the like.

Figure 17:
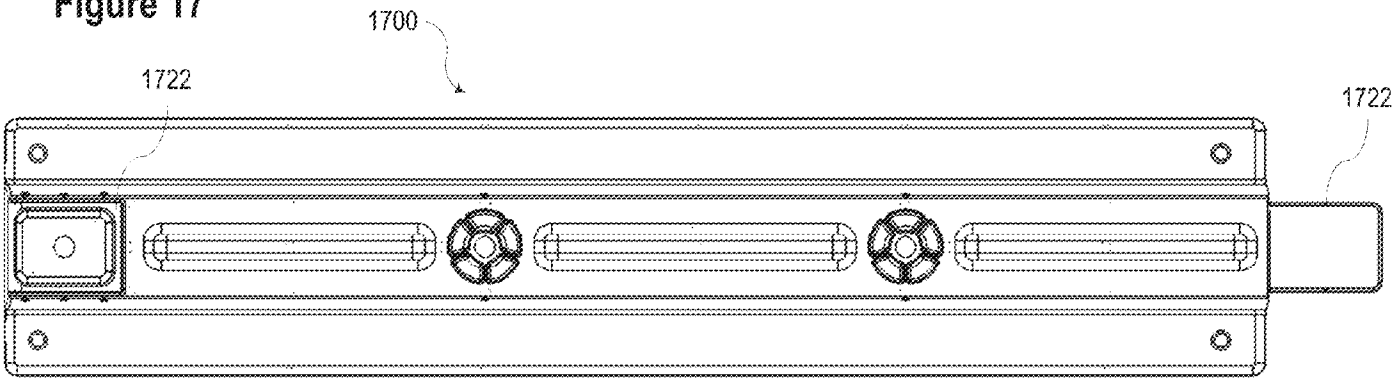
FIG. 17 illustrates a top view of the component illustrated in FIG. 14, according to various embodiments consistent with the present disclosure.

FIG. 17 illustrates a top view of the component illustrated in FIG. 14, according to various embodiments consistent with the present disclosure. FIG. 17 illustrates a U-shaped channel 1724 on one end of a component 1700 and a U-shaped extension 1722. In alternative embodiments, various mechanisms may be used to secure adjacent components together to form a track in place of U-shaped channel 1724 and U-shaped extension 1722.

Figure 18:
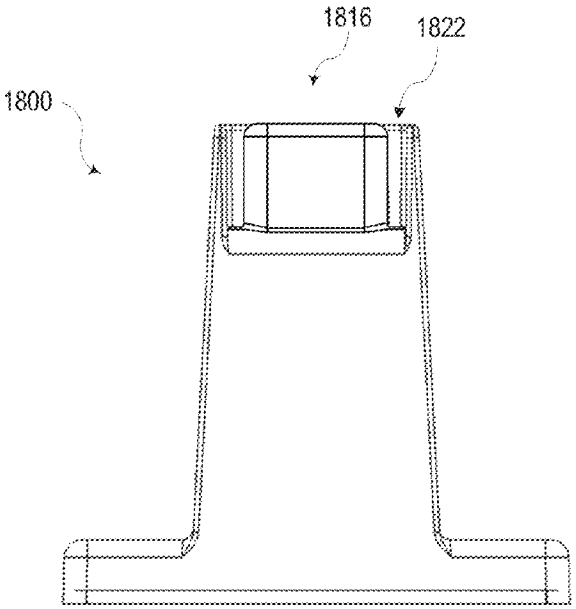
FIG. 18 illustrates an end view of the component illustrated in FIG. 14, according to various embodiments consistent with the present disclosure.

FIG. 18 illustrates an end view of the component illustrated in FIG. 14, according to various embodiments consistent with the present disclosure. Component 1800, as illustrated in FIG. 18 further illustrates that a top surface 1816 may be consistent to facilitate mounting of component 1800 to an overhead support.

The foregoing specification has been described with reference to various embodiments. However, one of ordinary skill in the art will appreciate that various modifications and changes can be made without departing from the scope of the present disclosure. Accordingly, this disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, a required, or an essential feature or element. The scope of the present invention should, therefore, be determined by the following claims.

What is claimed is:

1. A storage system, comprising:

a plurality of components configured to be directly coupled together to form a track, the track comprising at least two substantially parallel rows, each of the at least two substantially parallel rows comprising at least two directly coupled components, each of the plurality of components comprising:

a support surface;

a receiving member;

a plurality of apertures extending substantially through the component and configured to receive a fastener and to secure the component to an overhead support structure;

a substantially flat surface configured to abut the support structure when the component is secured to the overhead support structure; and a coupling component configured to directly couple to an adjacent component in the track, the coupling component comprising a protruding member that is configured to directly couple with the receiving member of an adjacent component; and a storage container comprising a storage compartment and flange disposed at least partially around the storage compartment;

wherein the storage container is configured to be received within the track and the flange of the storage container is configured to rest upon the support surfaces of at least two separate components in the track disposed on opposite sides of the storage container.

2. The storage system of claim 1, further comprising a spacing component configured to couple to the protruding member.

3. The storage system of claim 1, wherein the receiving member comprises a U-shaped channel.

4. The storage system of claim 1, wherein the protruding member comprises a U-shaped extension.

5. The storage system of claim 1, wherein each of the components further comprises a pair of ribs extending along a substantially flat top surface, the pair of ribs being disposed on opposite sides of the protruding member.

6. The storage system of claim 1, further comprising a spacing component configured to couple to a component at a terminating end of the track and configured to provide a substantially flat surface across a top surface of the component at the terminating end of the track.

7. The storage system of claim 1, wherein at least two of the plurality of apertures are separated by a distance of approximately 8 inches.

8. The storage system of claim 1, wherein at least one of the plurality of apertures further comprises a shoulder against which one of a washer and a head of the fastener is seated.

9. The storage system of claim 1, further comprising a plurality of fasteners configured to secure the plurality of components to an overhead support structure.

10. The storage system of claim 9, wherein the plurality of fasteners comprise one of a screw, a nail, a rivet, a bolt, and an anchor.

11. The storage system of claim 1, wherein the storage container is configured to be removed from the track only at one of a first end of the track and a second end of the track, the first end of the track and the second end of the track being disposed at opposite ends of the track.

12. The storage system of claim 1, wherein the storage container is configured to be removed from the track at any point along the length of the track by rotating the storage container with respect to the track.

13. The storage system of claim 1, wherein at least one of the plurality components is integrally formed.

14. The storage system of claim 1, wherein at least one of the plurality of components comprises a plurality of internal ribs configured to provide structural support to the support surface.

15. The storage system of claim 1, wherein each of the plurality of components has a cross-section in the shape of an inverted T.

16. The storage system of claim 1, wherein each of the support surface, the receiving member, the substantially flat surface, and the coupling component are integrally formed.

17. A storage system, comprising:

a plurality of components configured to be arranged in a track, the track comprising at least two substantially parallel rows of components, each of the plurality of components comprising:

a support surface;

a securing component configured to secure the component to a support structure; and a coupling component configured to directly couple adjacent components in the track;

a substantially flat top surface extending along a length of each component, the top surface configured to abut the support structure when the component is secured to the support structure;

wherein each of the support surface, the securing component, the coupling component, and the substantially flat top are integrally formed;

wherein the track is configured to receive a storage container having a flange, the flange being configured to rest upon the support surfaces of at least two separate components in the track disposed on opposite sides of the storage container.

18. The storage system of claim 17, wherein at least one of the plurality components is integrally formed.

* * * * *